US009527317B2

(12) United States Patent
Takeuchi

(10) Patent No.: US 9,527,317 B2
(45) Date of Patent: Dec. 27, 2016

(54) IMAGE FORMING APPARATUS

(71) Applicant: KYOCERA Document Solutions Inc., Osaka (JP)

(72) Inventor: Naoki Takeuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/979,470

(22) Filed: Dec. 27, 2015

(65) Prior Publication Data

US 2016/0185134 A1 Jun. 30, 2016

(30) Foreign Application Priority Data

Dec. 26, 2014 (JP) ..... 2014-266078

(51) Int. Cl.
*B65H 1/26* (2006.01)
*B41J 11/00* (2006.01)
(Continued)

(52) U.S. Cl.
CPC ..... *B41J 11/0095* (2013.01); *B41J 11/22* (2013.01); *B65H 1/266* (2013.01); *B65H 5/26* (2013.01); *B65H 7/04* (2013.01); *G03G 15/6508* (2013.01); *G03G 2215/00725* (2013.01); *G03G 2215/00729* (2013.01)

(58) Field of Classification Search
CPC ..... B65H 1/04; B65H 3/44; B65H 7/04; B65H 7/18; B65H 7/20; B65H 2405/332; B65H 2405/36; B65H 2405/361; B65H 1/266; B65H 5/26; B41J 11/0095; B41J 11/22; G30G 15/6508; G03G 2215/00729; G03G 2215/00725
(Continued)

(56) References Cited

U.S. PATENT DOCUMENTS 4,763,889 A 8/1988 Dei et al.
5,028,041 A * 7/1991 Kobayashi ..... B65H 7/04 271/258.04
(Continued)

FOREIGN PATENT DOCUMENTS

JP H05-186096 A 7/1993
JP 2003-104575 A 4/2003
(Continued)

*Primary Examiner* — David H Bollinger
(74) *Attorney, Agent, or Firm* — Hawaii Patent Services; Nathaniel K. Fedde; Kenton N. Fedde

(57) ABSTRACT

Provided is an image forming apparatus that shortens time period for interruption of printing. Image forming apparatus includes paper feeding cassettes, a paper sheet detection sensor, a sensing sensor, a paper feeding changeover determining part, and a system control part. The paper feeding cassettes are detachably loaded inside of an apparatus main body. Paper sheet detection sensor detects a paper sheet stored in the paper feeding cassette. Sensing sensor senses paper sheet conveyed along the carrying passage from the paper feeding cassette. Paper feeding changeover determining part determines whether or not changeover of paper feeding is possible, on the basis of operation state of the apparatus, a change in result of detection by paper sheet detection sensor, and the result of sensing by sensing sensor. System control part controls changeover of paper feeding on the basis of result of determination by paper feeding changeover determining part.

3 Claims, 3 Drawing Sheets

(51) Int. Cl.

| | |
|---|---|
| ***G03G 15/00*** | (2006.01) |
| ***B41J 11/22*** | (2006.01) |
| ***B65H 5/26*** | (2006.01) |
| ***B65H 7/04*** | (2006.01) |

(58) Field of Classification Search
USPC ..... 271/9.02, 9.03, 9.11
See application file for complete search history.

(56) References Cited

U.S. PATENT DOCUMENTS

| | | | | | |
|---|---|---|---|---|---|
| 5,991,556 | A * | 11/1999 | Yamashita | B65H 3/44 | 271/9.03 |
| 6,010,261 | A * | 1/2000 | Maekawa | B41J 11/0075 | 271/9.03 |
| 7,480,467 | B2 * | 1/2009 | Ueki | G03G 15/6508 | 271/9.01 |
| 2008/0292334 | A1 * | 11/2008 | Takahashi | B41J 11/0095 | 399/38 |
| 2009/0261524 | A1 * | 10/2009 | Nakayama | B65H 3/44 | 271/3.14 |
| 2010/0322689 | A1 * | 12/2010 | Ohtani | B65H 1/04 | 399/388 |
| 2011/0097130 | A1 * | 4/2011 | Hashimoto | B41J 13/0018 | 400/583 |
| 2015/0175368 | A1 * | 6/2015 | Hiroi | B65H 3/44 | 271/9.02 |

FOREIGN PATENT DOCUMENTS

| | | | |
|---|---|---|---|
| JP | 2005-145624 | A | 6/2005 |
| JP | 2014-034432 | A | 2/2014 |

* cited by examiner

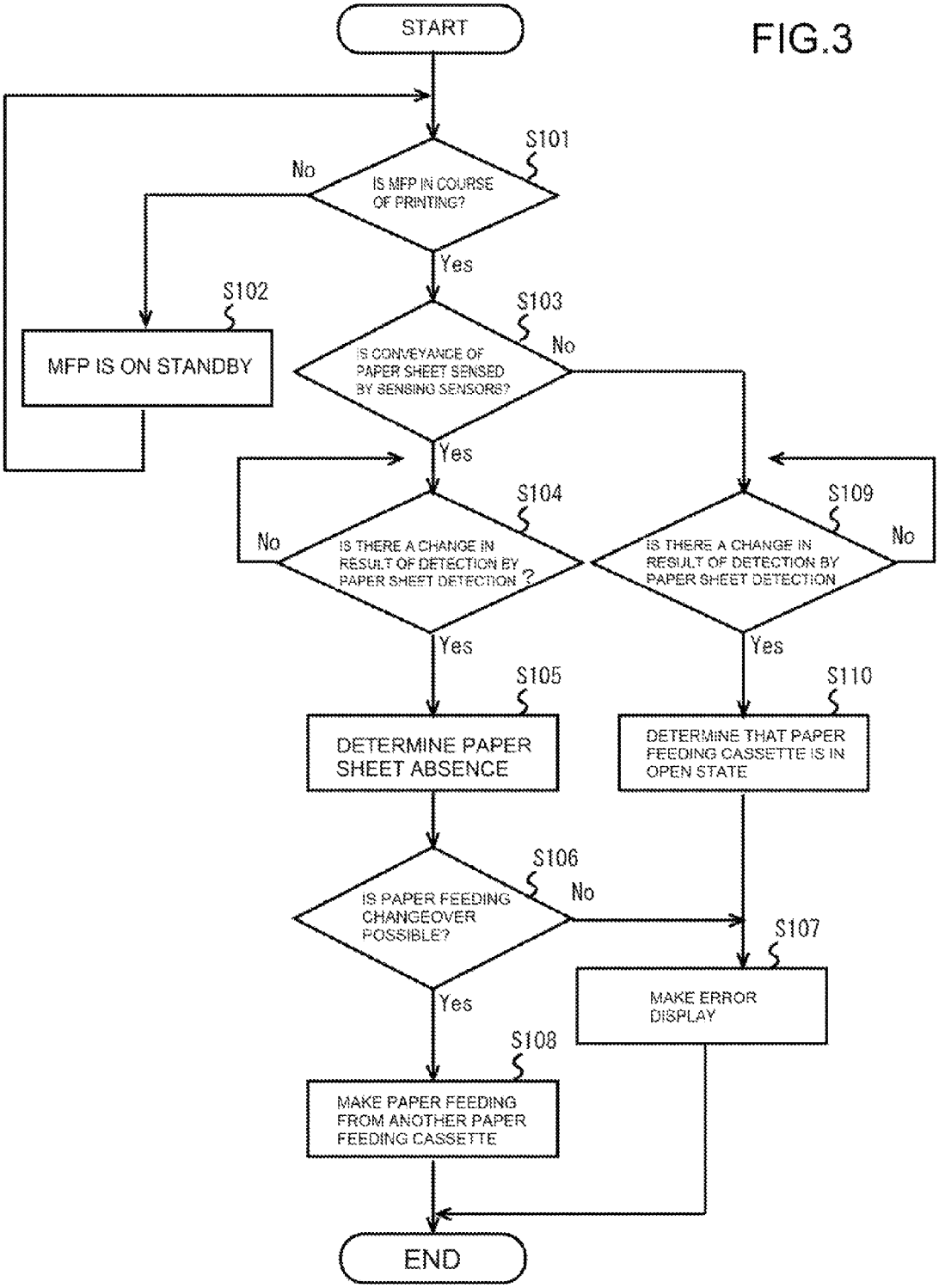
FIG.3
START
S101
IS MFP IN COURSE OF PRINTING?
No
Yes
S102
MFP IS ON STANDBY
S103
IS CONVEYANCE OF PAPER SHEET SENSED BY SENSING SENSORS?
No
Yes
S104
IS THERE A CHANGE IN RESULT OF DETECTION BY PAPER SHEET DETECTION ?
No
Yes
S109
IS THERE A CHANGE IN RESULT OF DETECTION BY PAPER SHEET DETECTION
No
Yes
S105
DETERMINE PAPER SHEET ABSENCE
S110
DETERMINE THAT PAPER FEEDING CASSETTE IS IN OPEN STATE
S106
IS PAPER FEEDING CHANGEOVER POSSIBLE?
No
Yes
S107
MAKE ERROR DISPLAY
S108
MAKE PAPER FEEDING FROM ANOTHER PAPER FEEDING CASSETTE
END

IMAGE FORMING APPARATUS

INCORPORATION BY REFERENCE

This application is based on and claims the benefit of priority from Japanese Patent Application No. 2014-266078 filed on Dec. 26, 2014, the contents of which are hereby incorporated by reference.

BACKGROUND

The present disclosure relates to an image forming apparatus that reads a document to generate image data.

For example, image forming apparatuses that are an MFP (Multifunction Peripheral) are often provided with an automatic paper feeding mechanism part that feeds paper sheets stored in a paper feeding cassette one by one to a carrying passage for guiding the fed paper sheet to a printing mechanism part.

In addition, with some image forming apparatuses, there are provided with a cassette detection sensor that detects the state in which the paper feeding cassette has been drawn out from the apparatus main body, that is, an open state, and the state in which the paper feeding cassette is loaded in the apparatus main body, that is, a closed state, and a paper sheet detection sensor that detects whether or not paper sheet is stored in the paper feeding cassette.

In addition, with some image forming apparatuses, there is provided with a plurality of paper feeding cassettes such that, when the paper sheets in any one of the paper feeding cassette have run out, the paper feeding can be changed over to that from another paper feeding cassette.

In other words, with such image forming apparatus, the plurality of sheet storage means that are grouped are disposed, being vertically stacked, and when the paper sheets stored in the sheet storage means that is in the course of paper feeding have run out, the paper feeding is changed over to that from another sheet storage means in the same group.

SUMMARY

An image forming apparatus of the present disclosure includes a plurality of paper feeding cassettes, a paper sheet detection sensor, a sensing sensor, a paper feeding changeover determining part, and a system control part. The plurality of paper feeding cassettes are loaded in the inside of an apparatus main body in a detachable manner. The paper sheet detection sensor detects a paper sheet stored in the paper feeding cassette. The sensing sensor senses a paper sheet conveyed along a carrying passage from the paper feeding cassette. The paper feeding changeover determining part performs processing to determine whether changeover of paper feeding is possible or not, on the basis of the operation state of the apparatus, a change in the result of detection by the paper sheet detection sensor, and the result of sensing by the sensing sensor. The system control part performs processing to control changeover of paper feeding on the basis of the result of determination by the paper feeding changeover determining part.

BRIEF DESCRIPTION OF THE DRAWINGS

FIG. 3 illustrates the steps of processing in paper feeding changeover by the MFP in FIG. 1.

DETAILED DESCRIPTION

Hereinbelow, an embodiment of an image forming apparatus of the present disclosure will be explained with reference to FIG. 1 to FIG. 3. In the following explanation, as an example of the image forming apparatus, the image forming apparatus is assumed to be an MFP (Multifunction Peripheral) that provides multiple operation functions for such jobs as copying, printing, and facsimiling.

Figure 1:
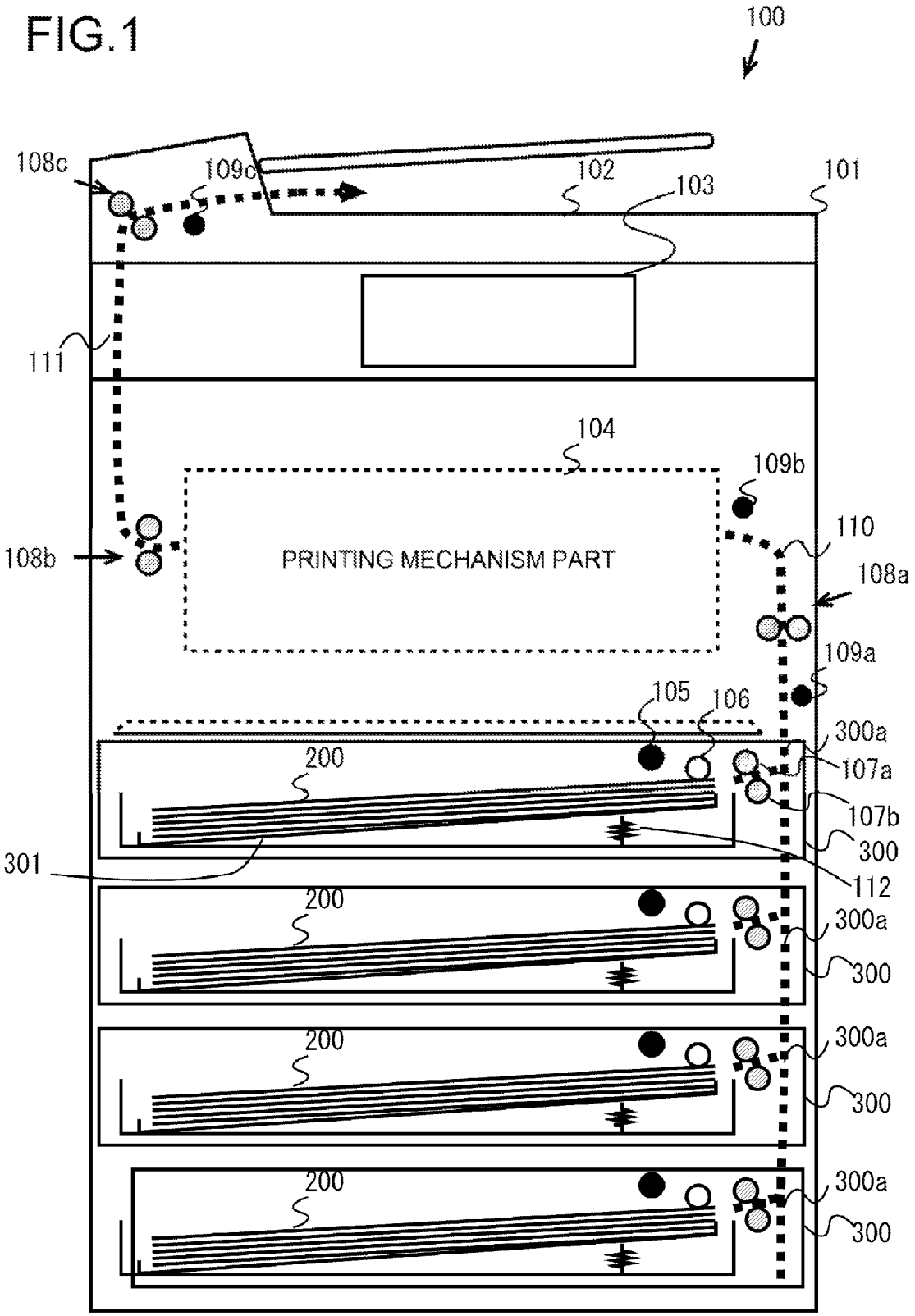
FIG. 1 shows an embodiment in the case where the image forming apparatus in the present disclosure is assumed to be an MFP.
Figure 2:
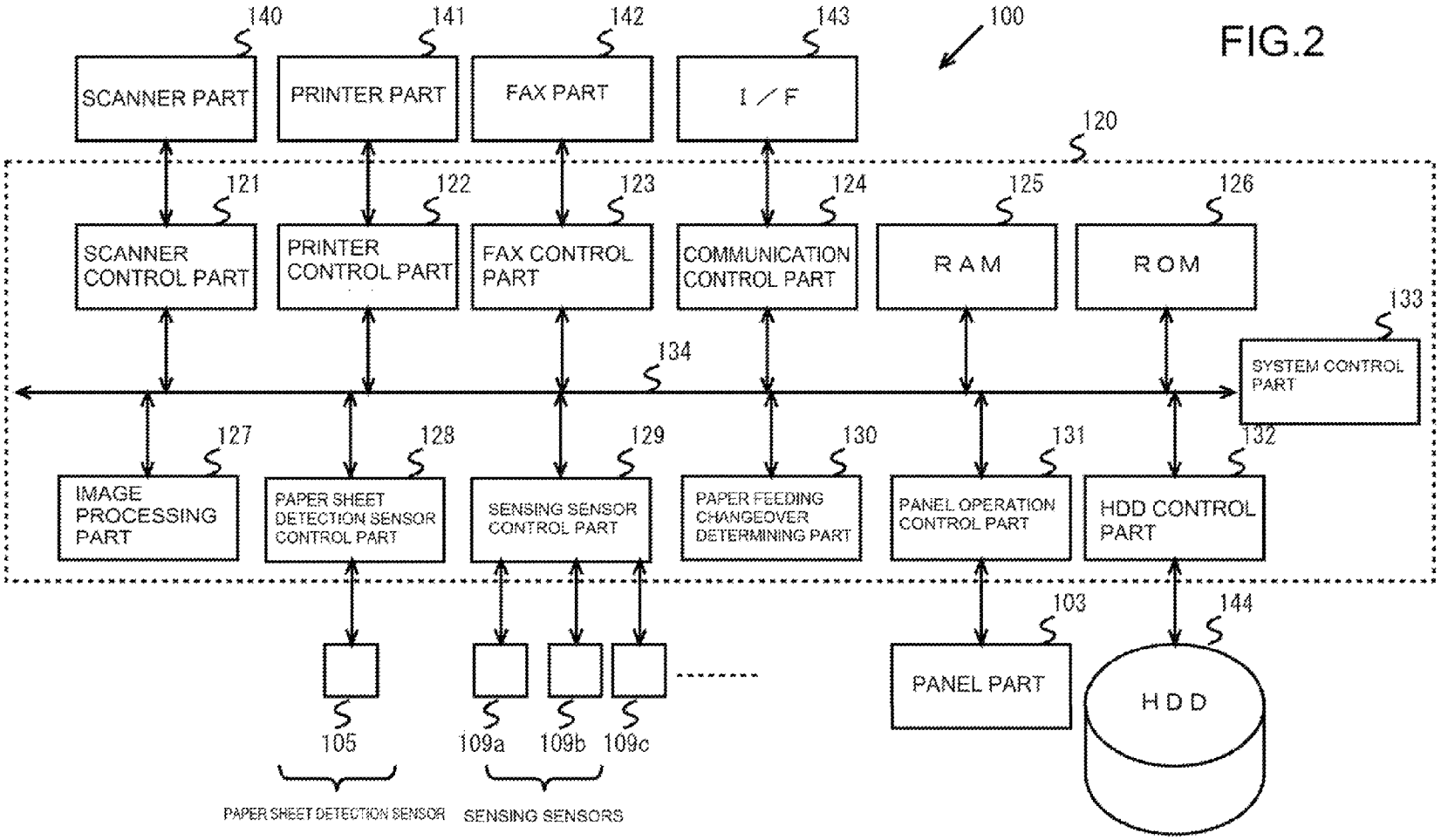
FIG. 2 illustrates a configuration of the MFP in FIG. 1.

First, as shown in FIG. 1, in an MFP 100, a paper delivery tray 102 and a panel part 103 are provided in the upper part of an MFP main body 101. In addition, in the inside of the MFP main body 101, a printing mechanism part 104 having such components as a photosensitive drum is disposed. Under the printing mechanism part 104, a plurality of paper feeding cassettes 300, which store a plurality of paper sheets 200, are disposed, being stacked along a vertical direction. In addition, these paper feeding cassettes 300 are detachable from the MFP main body 101. In addition, for each paper feeding cassette 300, there is provided with a common carrying passage 300*a*, which is also used for a paper sheet 200 that is fed from a paper feeding cassette 300 located at a lower stage.

In addition, in the inside of the MFP main body 101, there are disposed a paper sheet detection sensor 105, a feeding roller 106, a driving roller 107*a*, and a driven roller 107*b*. These paper sheet detection sensor 105, feeding roller 106, driving roller 107*a*, and driven roller 107*b* are disposed in correspondence to the loading position of the respective paper feeding cassettes 300. The paper sheet detection sensor 105 may be mechanical or optical one.

In addition, in the inside of the MFP main body 101, there are provided a sensing sensor 109*a*, conveyance rollers 108*a*, a sensing sensor 109*b*, conveyance rollers 108*b* and 108*c*, and a sensing sensor 109*c*. The sensing sensor 109*a*, the conveyance rollers 108*a*, and the sensing sensor 109*b* are disposed along a carrying passage 110 from the respective paper feeding cassettes 300 to the printing mechanism part 104. In addition, the conveyance rollers 108*b* and 108*c*, and the sensing sensor 109*c* are provided along a carrying passage 111 from the printing mechanism part 104 to the paper delivery tray 102.

In the paper feeding cassette 300, there is provided a lifting plate 301, which is pushed up at a place opposed to the feeding roller 106 by a lifting member 112, which is provided in the inside of the MFP main body 101.

Then, with the lifting plate 301 being pushed up by the lifting member 112, the distal end portion of the paper sheet 200 on the lifting plate 301 is pressed against the feeding roller 106. Thereby, the paper sheets 200 in the paper feeding cassette 300 are fed out one by one by the feeding roller 106. In addition, in the state in which the distal end portion of the paper sheet 200 on the lifting plate 301 is pushed up, detection of the paper sheet 200 by the paper sheet detection sensor 105 is performed. Here, if the paper sheet detection sensor 105 detects the paper sheet 200 that is stored in the paper feeding cassette 300, the paper sheet detection sensor 105 detects paper sheet presence. Contrarily, if the paper sheet detection sensor 105 cannot detect the paper sheet 200 that is stored in the paper feeding cassette 300, the paper sheet detection sensor 105 detects paper sheet absence. Specifically, if no paper sheet 200 is stored in the paper feeding cassette 300, the paper sheet detection sensor 105 detects paper sheet absence. Further, if the paper feeding cassette 300 is in the open state, the paper sheet detection sensor 105 cannot detect any paper sheet 200, which is to be stored in the paper feeding cassette 300, and thus detects paper sheet absence, regardless of whether paper sheet 200 is stored in the paper feeding cassette 300.

The paper sheet 200 that has been fed by the feeding roller 106 is conveyed to the printing mechanism part 104 by the conveyance rollers 108*a* along the carrying passage 110. The paper sheet 200, which has been subjected to printing by the printing mechanism part 104, is conveyed to the paper delivery tray 102 by the conveyance rollers 108*b* and 108*c* along the carrying passage 111. In the case where, after the respective sensing sensors 109*a* to 109*c* having sensed the paper sheet 200, a specific period of time has elapsed without the paper sheet 200 being sensed, the conveyance of the paper sheet 200 is sensed by the respective sensing sensors 109*a* to 109*c*. In addition, in the case where any one of the sensing sensors 109*a* to 109*c* has sensed the paper sheet 200, but there is no change in the result of sensing even if a specific period of time has elapsed (in other words, the conveyance of the paper sheet 200 has been kept sensed), it is determined that there has occurred a paper sheet jam in the place where the paper sheet 200 is sensed, and the conveyance of the paper sheet 200 is not sensed. In addition, in the case where the paper sheet 200 has not been sensed by the respective sensing sensors 109*a* to 109*c*, it is determined that there is no paper sheet 200 in the carrying passage 111, and thus the conveyance of the paper sheet 200 is not sensed. As the specific period of time, a period of time that is longer than is required for the paper sheet 200 to pass through the sensing sensors 109*a* to 109*c* is set. The specific period of time may be a fixed value, or a value that varies depending upon the size of the paper sheet to be conveyed.

In addition, as described above, the carrying passages 110 and 111 convey the paper sheet 200 from the respective paper feeding cassettes 300 to the paper delivery tray 102 through the printing mechanism part 104. The carrying passage 110 is continued to the common carrying passage 300*a*, which is used by the respective paper feeding cassettes 300.

In the present embodiment, although the details are later described, in the case where the paper sheets 200 in a paper feeding cassette 300 have run out in the course of printing, and it can be determined that the paper feeding cassette 300 is in the closed state (in the state in which it is loaded in the MFP main body 101), the paper feeding is changed over to that from another paper feeding cassette 300.

Next, with reference to FIG. 2, the configuration of the MFP 100 will be explained. The MFP 100 includes a control part 120, a scanner part 140, a printer part 141, a FAX part 142, an I/F (interface) 143, a paper sheet detection sensor 105, sensing sensors 109*a* to 109*c*, a panel part 103, and an HDD (hard disk drive) 144.

The scanner part 140 inputs image data of a document read by an image sensor to the control part 120. In other words, the scanner part 140 converts an image signal for the document from the image sensor into digital image data, and sequentially inputs it to the control part 120.

The printer part 141 has the above-mentioned printing mechanism part 104, and on the basis of the image data outputted from the control part 120, prints an image on the paper sheet 200. The FAX part 142 transmits the image data outputted from the control part 120 to a facsimile on the opposite party through a telephone line, and receives image data from the facsimile on the opposite party to input it to the control part 120. In other words, the FAX part 142 compresses and modulates the image data outputted from the control part 120 to transmit it to the facsimile on the opposite party, while controlling the connection to the telephone line with an NCU (Network Control Unit). In addition, the FAX part 142 demodulates and expands the image data from the facsimile on the opposite party to input it to the control part 120, while connecting to the telephone line with the NCU.

The I/F 143 performs a communication with a client terminal, for example, through a network, such as an in-house LAN (Local Area Network).

The paper sheet detection sensor 105, as described above, detects the paper sheet 200 that is stored in the paper feeding cassette 300. The sensing sensors 109*a* to 109*c*, as described above, sense the paper sheet 200 that is conveyed along the carrying passages 110 and 111.

The panel part 103 displays operation buttons, and the like, for selecting any one of the printer function, the FAX function, and the scanning function of the MFP 100, and performing various settings. In the HDD 144, application programs, and the like, for providing various functions of the MFP 100 are stored. In addition, in the HDD 144, a user box, and the like, are provided.

The control part 120 controls the entire operation of the MFP 100. The control part 120 includes a scanner control part 121, a printer control part 122, a FAX (facsimile) control part 123, a communication control part 124, an RAM (Random Access Memory) 125, an ROM (Read Only Memory) 126, an image processing part 127, a paper sheet detection sensor control part 128, a sensing sensor control part 129, a paper feeding changeover determining part 130, a panel operation control part 131, an HDD control part 132, and a system control part 133. In addition, these are connected to a data bus 134. The scanner control part 121, the printer control part 122, the FAX (facsimile) control part 123, the communication control part 124, the image processing part 127, the paper sheet detection sensor control part 128, the sensing sensor control part 129, the paper feeding changeover determining part 130, the panel operation control part 131, the HDD control part 132, and the system control part 133 are a processor, such as a Central Processing Unit (CPU), having one circuit or more, being capable of reading various programs to execute them, and executing various programs that have been previously incorporated in the inside. Here, the circuit can be an electronic part in which a plurality of electronic elements are connected by wiring, or an electronic substrate.

The scanner control part 121 controls the reading operation of the scanner part 140. The printer control part 122 performs processing to control the printing operation of the printer part 141. The FAX control part 123 controls the image data transmission/reception operation by the FAX part 142. The communication control part 124 performs processing to control the communication through the I/F 143.

The RAM 125 is a work memory for executing a program. The ROM 126 has an area for storing control programs, and the like, to perform operation check, and the like, of the respective parts. The image processing part 127 performs image processing for image data of a document read by, for example, the scanner part 140.

The paper sheet detection sensor control part 128 performs processing to control the paper sheet detection operation by the paper sheet detection sensor 105. The sensing sensor control part 129 performs processing to control the operation of sensing the paper sheet 200 by the sensing sensors 109*a* to 109*c*.

The paper feeding changeover determining part 130 performs processing to determine whether paper feeding changeover is possible or not, from the operation state of the MFP 100 and the result of detection by the paper sheet detection sensor 105, and the result of sensing by the sensing sensors 109*a* to 109*c*. Here, the operation state of the MFP 100 means the state in which it is in the course of printing or the state in which it is on standby. In addition, the result of detection by the paper sheet detection sensor 105 means that paper sheet absence is detected from paper sheet presence, or that paper sheet presence is detected from paper sheet absence. In addition, the result of sensing by the sensing sensors 109*a* to 109*c* means that the paper sheet 200 that is conveyed along the carrying passages 110 and 111 is sensed.

The paper feeding changeover determining part 130 first determines the operation state of the MFP 100, that is, whether it is in the course of printing or on standby. Then, when, in the course of printing, for example, the conveyance of the paper sheet 200 in the carrying passages 110 and 111 is sensed by the sensing sensors 109*a* to 109*c*, if the result of detection by the paper sheet detection sensor 105 is changed from paper sheet presence to paper sheet absence, the paper feeding changeover determining part 130 determines that the paper sheets 200 in the paper feeding cassette 300 have run out. In this case, that, in the course of printing, the conveyance of the paper sheet 200 in the carrying passages 110 and 111 is sensed by the sensing sensors 109*a* to 109*c* means that there has occurred no paper sheet jam. Therefore, the paper feeding changeover determining part 130 can determine that the paper feeding cassette 300 with which the paper sheets 200 have run out is in the closed state.

In addition, when, in the course of printing, for example, the conveyance of the paper sheet 200 in the carrying passages 110 and 111 is not sensed by the sensing sensors 109*a* to 109*c*, if the result of detection by the paper sheet detection sensor 105 is changed from paper sheet presence to paper sheet absence, the paper feeding changeover determining part 130 determines that the paper feeding cassette 300 is in the open state.

Then, in the case where the paper feeding changeover determining part 130 has determined that the paper feeding cassette 300 with which the paper sheets 200 have run out in the course of printing is in the closed state, the paper feeding changeover determining part 130 determines that the paper feeding can be changed over to that from another paper feeding cassette 300. In this case, if all the paper feeding cassettes 300 store the paper sheets 200 having the same size as that of the paper sheet 200 in the course of printing, in other words, as that specified by the user, it is determined that the paper feeding can be changed over from the paper feeding cassette 300 with which the paper sheets 200 have run out to a paper feeding cassette 300 located at a lower stage, for example. If a paper feeding cassette 300 located at an upper stage above the paper feeding cassette 300 with which the paper sheets 200 have run out stores paper sheets 200 having the same size as that specified by the user, it may be determined that the paper feeding can be changed over to that from the paper feeding cassette 300 at the upper stage.

Contrarily to this, if the paper feeding changeover determining part 130 has determined that the paper feeding cassette 300 is in the open state, the paper feeding changeover determining part 130 determines that the paper feeding cannot be changed over to that from another paper feeding cassette 300.

In the case where all the other paper feeding cassettes 300 have no paper sheets 200, or the size of the paper sheets 200 stored in the other paper feeding cassettes 300 is different from that specified by the user, the paper feeding changeover determining part 130 determines that the changeover is impossible. However, it may be determined that, if there is no specification of the size by the user, for example, the paper feeding can be changed over to that from another paper feeding cassette 300.

The panel operation control part 131 controls the display operation of the panel part 103. The HDD control part 132 controls the writing/reading of data into/from the HDD 144, and the like. The system control part 133 mainly controls changeover of the paper feeding to that from another paper feeding cassette 300 on the basis of the result of determination by the paper feeding changeover determining part 130. The timing at which the system control part 133 changes over the paper feeding to that from another paper feeding cassette 300 can be arbitrarily set by an operation through the panel part 103. In addition, in the case where the result of determination by the paper feeding changeover determining part 130 shows that changeover is impossible, the system control part 133 causes the panel part 103, through the panel operation control part 131, to give an error display indicating that changeover of paper feeding is impossible.

Next, with reference to FIG. 3, the operation in paper feeding changeover by the MFP 100 will be explained. In the following explanation, it is assumed for convenience of explanation that, in the respective paper feeding cassettes 300, paper sheets 200 having the same size (for example, a size of A4) are stored.

First, the paper feeding changeover determining part 130 determines whether or not the MFP 100 is in the course of printing (Step S101). If the MFP 100 is not in the course of printing (NO at Step S101), the paper feeding changeover determining part 130 determines that the MFP 100 is on standby (Step S102). In addition, if it is determined that the MFP 100 is in the course of printing, the paper feeding changeover determining part 130 determines whether or not the conveyance of the paper sheet 200 in the carrying passages 110 and 111 is sensed by the sensing sensors 109*a* to 109*c* (Step S103).

Here, if it is determined that the conveyance of the paper sheet 200 in the carrying passages 110 and 111 is sensed by the sensors 109*a* to 109*c* (YES at Step S103), the paper feeding changeover determining part 130 determines whether or not there is a change in the result of detection by the paper sheet detection sensor 105 corresponding to the paper feeding cassette 300 in use (Step S104). If there is no change in the result of detection by the paper sheet detection sensor 105, the paper feeding changeover determining part 130 is brought into a state of waiting for a determination (NO at Step S104). Contrarily to this, if it is determined that there is a change in the result of detection by the paper sheet detection sensor 105 (YES at Step S104), the paper feeding changeover determining part 130 determines that the paper sheets 200 in the paper feeding cassette 300 have run out (Step S105). In this case, as described above, that, in the course of printing, the conveyance of the paper sheet 200 in the carrying passages 110 and 111 is sensed by the sensing sensors 109*a* to 109*c* means that there has occurred no paper sheet jam. Therefore, it can be determined that the paper feeding cassette 300 with which the paper sheets 200 have run out is in the closed state.

Then, if, at Step S105, the paper feeding changeover determining part 130 determines that the paper sheets 200 in the paper feeding cassette 300 have run out, and further determines that the paper feeding cassette 300 with which the paper sheets 200 have run out is in the closed state, the paper feeding changeover determining part 130 determines whether or not paper feeding changeover is possible (Step S106).

Here, in the case where all the other paper feeding cassettes 300 have no paper sheets 200, or the size of the paper sheets 200 stored in the other paper feeding cassettes 300 is different from that specified by the user, the paper feeding changeover determining part 130 determines that the changeover is impossible (NO at Step S106), and notifies the system control part 133 thereof. In this case, the system control part 133 causes the panel part 103, through the panel operation control part 131, to give an error display indicating that changeover of paper feeding is impossible (Step S107).

Contrarily to this, if paper sheets 200 having the same size as that of the paper sheet 200 in the course of printing, in other words, paper sheets 200 having the same size as that specified by the user are stored in another paper feeding cassette 300, the paper feeding changeover determining part 130 determines that the paper feeding can be changed over to that from the another paper feeding cassette 300, and notifies the system control part 133 thereof.

In this case, the system control part 133 changes over the paper feeding to that from, for example, a paper feeding cassette 300 at a lower stage (Step S108). The timing at which the system control part 133 changes over the paper feeding to that from, for example, the paper feeding cassette 300 at a lower stage follows the period of time that has been arbitrarily set by an operation through the panel part 103, for example. Therefore, if the period of time that has been set is short, changeover of the paper feeding to that from, for example, the paper feeding cassette 300 at a lower stage is rapidly performed.

On the other hand, if it is determined at Step S103 that the conveyance of the paper sheet 200 in the carrying passages 110 and 111 is not sensed by the sensors 109*a* to 109*c* (NO at Step S103) , the paper feeding changeover determining part 130 determines whether or not there is a change in the result of detection by the paper sheet detection sensor 105 corresponding to the paper feeding cassette 300 in use (Step S109). If there is no change in the result of detection by the paper sheet detection sensor 105, the paper feeding changeover determining part 130 is brought into a state of waiting for a determination (NO at Step S109). Contrarily to this, if it is determined that there is a change in the result of detection by the paper sheet detection sensor 105 (YES at Step S109), the paper feeding changeover determining part 130 determines that the paper feeding cassette 300 is in the open state (Step S110), and notifies the system control part 133 thereof. Cases in which a determination of NO at Step S103 include, for example, the case where there has occurred a paper sheet jam in the carrying passage 110, and the case where, in copying processing, the MFP 100 is in the course of scanning of a document, and the conveyance of a paper sheet 200 has not yet started.

In this case, the system control part 133 causes the panel part 103, through the panel operation control part 131, to give an error display indicating that changeover of paper feeding is impossible (Step S107). Thereafter, with the result of detection by the paper sheet detection sensor 105 being changed from paper sheet absence to paper sheet presence, the paper feeding changeover determining part 130 determines that the paper feeding cassette 300 has been changed into a closed state, and may cause the printing to be resumed using the paper feeding cassette 300 that has been determined to be in the closed state.

In this way, in the present embodiment, according to the determination by the paper feeding changeover determining part 130 on the basis of the operation state of the MFP 100, a change in the result of detection by the paper sheet detection sensor 105 that detects the paper sheet 200 stored in the paper feeding cassette 300, and the result of sensing by the sensing sensors 109*a* to 109*c* that sense the paper sheet 200 conveyed along the carrying passages 110 and 111 from the paper feeding cassette 300, the system control part 133 performs control of the changeover of paper feeding. Therefore, in the case where the paper sheets 200 in the paper feeding cassette 300 have run out in the course of printing, the period of time for interruption of printing can be shortened.

In other words, when, in the course of printing, the conveyance of the paper sheet 200 in the carrying passages 110 and 111 is sensed by the sensing sensors 109*a* to 109*c*, if the result of detection by the paper sheet detection sensor 105 is changed from paper sheet presence to paper sheet absence, the paper feeding changeover determining part 130 determines that the paper sheets 200 in the paper feeding cassette 300 have run out. Then, the paper feeding changeover determining part 130 notifies the system control part 133 that it is possible to change over the paper feeding cassette to another one. Thereby, the system control part 133 can change over the paper feeding of the paper sheet 200 to that from the another paper feeding cassette 300.

In addition, when, in the course of printing, the conveyance of the paper sheet 200 in the carrying passages 110 and 111 is not sensed by the sensing sensors 109*a* to 109*c*, if the result of detection by the paper sheet detection sensor 105 is changed from paper sheet presence to paper sheet absence, the paper feeding changeover determining part 130 determines that the paper feeding cassette 300 is in the open state (the state in which it is drawn out from the MFP main body 101). Then, the paper feeding changeover determining part 130 notifies the system control part 133 that it is impossible to change over the paper feeding cassette 300 to another one. Thereby, the system control part 133 will not change over the paper feeding of the paper sheet 200 to that from the another paper feeding cassette 300, whereby occurrence of the above-mentioned paper sheet jam at the time when the paper feeding cassette 300 is in the open state can be prevented.

In the above-described embodiment, the processes in the course of printing have been explained, however, in the case where the MFP 100 is on standby, the processes at Step 5109 to 5110 following Step S103 in FIG. 3 may be performed. At that time, in the case where the conveyance of the paper sheet 200 is not sensed by the sensors 109*a* to 109*c* (NO at Step S103), if the result of detection by the paper sheet detection sensor 105 is changed from paper sheet presence to paper sheet absence (YES at Step S109), the paper feeding changeover determining part 130 determines that the paper feeding cassette 300 is in the open state (Step S109). At this time, the paper feeding changeover determining part 130 may give a notification that it is impossible to use the paper feeding cassette 300 that has been determined to be in the open state and the paper feeding cassette 300 located at a stage lower than that.

Thereafter, if the result of detection by the paper sheet detection sensor 105 is changed from paper sheet absence to paper sheet presence, paper feeding changeover determining part 130 determines that the paper feeding cassette 300 has been brought into a closed state, and may give a notification that it is possible to use the paper feeding cassette 300 that has been determined to be in the closed state and the paper feeding cassettes 300 located at a stage lower than that.

What is claimed is:

1. An image forming apparatus comprising:

a plurality of paper feeding cassettes that are loaded in a detachable manner in the inside of an apparatus main body;

a paper sheet detection sensor that detects a paper sheet stored in a paper feeding cassette in use of the plurality of paper feeding cassettes;

a sensing sensor that senses a paper sheet conveyed along a carrying passage from the paper feeding cassette in use;

a paper feeding changeover determining part that performs processing to determine whether changeover of paper feeding from the paper feeding cassette in use is possible or not, on the basis of the operation state of the apparatus, a change in the result of detection by the paper sheet detection sensor, and the result of sensing by the sensing sensor; and a system control part that performs processing to control changeover of paper feeding on the basis of the result of determination by the paper feeding changeover determining part;

wherein the paper feeding changeover determining part:

performs processing to determine that, when, in the course of printing, the conveyance of the paper sheet is not sensed by the sensing sensor, if the result of detection by the paper sheet detection sensor is changed from paper sheet presence to paper sheet absence, the paper feeding cassette in use has been drawn out from the apparatus main body, and performs processing to notify the system control part that changeover of the paper feeding cassette in use is impossible.

2. The image forming apparatus according to claim 1, wherein the paper feeding changeover determining part performs processing to determine that, when, in the course of printing, the conveyance of the paper sheet is sensed by the sensing sensor, if the result of detection by the paper sheet detection sensor is changed from paper sheet presence to paper sheet absence, the paper sheets in the paper feeding cassette in use have run out, and performs processing to notify the system control part that changeover of the paper feeding cassette to another is possible.

3. The image forming apparatus according to claim 1, wherein the plurality of paper feeding cassettes are disposed in the inside of the apparatus main body, being vertically stacked, and each is provided with a common carrying passage that is also used for the paper sheet fed from a lower stage.

* * * * *